US011278751B2

(12) United States Patent
Delprat et al.

(10) Patent No.: US 11,278,751 B2
(45) Date of Patent: Mar. 22, 2022

(54) PROTECTION AND RESPIRATORY EQUIPMENT FOR AIRCRAFT PILOT AND INDIVIDUAL USER

(71) Applicant: Safran Aerotechnics, Plaisir (FR)

(72) Inventors: Jean-Baptiste Delprat, Chaville (FR); Olivier Potet, La Ville du Bois (FR)

(73) Assignee: SAFRAN AEROTECHNICS SAS, Plaisir (FR)

( * ) Notice: Subject to any disclaimer, the term of this patent is extended or adjusted under 35 U.S.C. 154(b) by 292 days.

(21) Appl. No.: 16/426,133

(22) Filed: May 30, 2019

(65) Prior Publication Data

US 2019/0374796 A1 Dec. 12, 2019

(30) Foreign Application Priority Data

Jun. 6, 2018 (FR) ..... 1854906
Jul. 5, 2018 (EP) ..... 18181894

(51) Int. Cl.

| | |
|---|---|
| ***A62B 18/08*** | (2006.01) |
| ***A62B 7/14*** | (2006.01) |
| ***A62B 17/04*** | (2006.01) |
| ***A62B 18/02*** | (2006.01) |
| ***A62B 18/04*** | (2006.01) |

(52) U.S. Cl.

CPC ..... *A62B 18/084* (2013.01); *A62B 7/14* (2013.01); *A62B 17/04* (2013.01); *A62B 18/02* (2013.01); *A62B 18/04* (2013.01)

(58) Field of Classification Search

CPC .. B64G 6/00; A62B 18/00; A62B 7/14; A62B 17/04; A62B 18/02; A62B 18/04; A62B 9/00; A62B 9/04; A62B 17/001; A41D 13/1153; B64D 10/00; B64D 2010/002; B64D 2010/005; B64D 2010/007

See application file for complete search history.

(56) References Cited

U.S. PATENT DOCUMENTS 456,687 A * 7/1891 Bader ..... A62B 18/04 128/201.16
518,822 A * 4/1894 Moran ..... A62B 17/04 128/201.23

(Continued)

FOREIGN PATENT DOCUMENTS

IT 20155514 A1 5/2017

OTHER PUBLICATIONS

European Patent Application No. 18181894.9, Partial European Search Report, dated Jan. 7, 2019, 15 pages.

*Primary Examiner* — Tu A Vo

(74) *Attorney, Agent, or Firm* — Kilpatrick Townsend & Stockton LLP

(57) ABSTRACT

A protection equipment including a base member with a deformable membrane which includes a central orifice with an adaptive size, configured to selectively circumvent in a substantially airtight manner the neck of the user, a hood coupled in a substantially airtight manner the base member, whereby a substantially closed volume is provided, the closed volume being delimited by the deformable membrane, the base member, the neck and the hood, and an aperture control device to change the central orifice of the deformable membrane from a large aperture state to a small aperture state.

12 Claims, 5 Drawing Sheets

(56) References Cited

U.S. PATENT DOCUMENTS 1,184,785 A * 5/1916 Stern ..... A62B 18/02 128/201.15
1,215,327 A 2/1917 Ackerman
1,928,238 A * 9/1933 Willson ..... H02P 1/46 2/205
2,335,474 A * 11/1943 Beall ..... B64D 10/00 600/20
2,435,167 A * 1/1948 Stetson ..... A62B 17/04 128/201.23
3,058,463 A * 10/1962 Goodrich, Jr. ..... A41D 13/1153 128/863
3,221,339 A * 12/1965 Correale, Jr. ..... B64D 10/00 2/6.2
3,239,843 A * 3/1966 Odilon ..... B64D 10/00 2/6.4
3,258,010 A * 6/1966 Austin ..... B64D 10/00 128/201.25
3,438,060 A * 4/1969 John ..... A62B 18/04 2/6.3
3,911,914 A * 10/1975 Johansson ..... A62B 18/04 128/201.23
4,186,735 A * 2/1980 Henneman ..... A62B 7/00 128/201.25
4,236,514 A 12/1980 Moretti
4,484,575 A * 11/1984 Brockway ..... A62B 17/04 128/201.23
4,619,254 A * 10/1986 Moretti ..... A62B 17/04 128/201.23
4,620,538 A * 11/1986 Koegel ..... A61M 16/0627 128/201.23
4,677,976 A * 7/1987 Fujinuma ..... A62B 23/02 128/201.25
5,133,344 A * 7/1992 Jurrius ..... A62B 17/04 128/201.23
5,625,902 A * 5/1997 Drews ..... A62B 17/04 128/201.23
6,854,459 B1 * 2/2005 Cox ..... A62B 17/04 128/201.22
7,743,433 B1 * 6/2010 Grove ..... A62B 17/00 2/465
2003/0200966 A1 * 10/2003 Frund, Jr. ..... A62B 17/001 128/201.29
2005/0193472 A1 * 9/2005 Courtney ..... A62B 17/04 2/202
2007/0028372 A1 * 2/2007 VanDerWoude ..... A62B 17/04 2/457
2009/0235928 A1 * 9/2009 Borsari ..... A61M 16/0627 128/201.23
2011/0226240 A1 * 9/2011 Navalesi ..... A61M 16/06 128/201.23
2015/0290480 A1 * 10/2015 Ritchie ..... A61M 16/06 128/201.23
2018/0222559 A1 * 8/2018 Beyeler ..... A41D 13/012

* cited by examiner

PROTECTION AND RESPIRATORY EQUIPMENT FOR AIRCRAFT PILOT AND INDIVIDUAL USER

FIELD OF THE INVENTION

The present disclosure relates to protection and respiratory equipment for aircraft pilots and relates to individual user protection equipment.

FUNDING STATEMENT

The project leading to this application has received funding from the Clean Sky 2 Joint Undertaking under the European Union's Horizon 2020 research and innovation program under grant agreement No. CS2-LPA-GAM-2014-2015-0I.

BACKGROUND OF THE DISCLOSURE

There is a trend to push and/or oblige pilots and/or first officers of aircrafts to wear a respiratory equipment in a preventive mode, such respiratory equipment being intended to avoid hypoxia phenomenon in case of decompression at certain cruising altitudes. Also, other crew members can necessitate using individual protection equipment, so that they can move around the cabin and perform various tasks for a time duration that can be rather long.

More precisely, for pilot or co-pilot, a preventive wear of a respiratory equipment is required for cruising altitudes above 41 kfeet and/or if only one pilot is present in the flight deck for cruising altitudes above 25 kfeet. This preventive wear may be also required for some flight domain conditions and/or some geographical areas (e.g. high mountains area).

Under this perspective, there is a need to propose new solutions to favor the practicality and comfort of respiratory equipment.

Also the inventors have found that the below proposed solution can also be applied to a hood-type protection equipment for any individual user, in particular crew members but also in situations where smoke comes out and prevents normal breathing.

SUMMARY OF THE DISCLOSURE

According to one aspect of the present invention, there is disclosed a protection equipment comprising:

a base member (2;102) with a deformable membrane (3) which comprises a central orifice (OC) with an adaptive size, configured to selectively circumvent in a substantially airtight manner the neck (NN) of the user (U), a hood (104) coupled in a substantially airtight manner to the base member, whereby a substantially closed volume (CV) is provided, the closed volume being delimited by the deformable membrane, the base member and the hood.

Thanks to these dispositions, the head of the user is isolated from the exterior air. The proposed protection equipment thereby provides protection against contaminated air environment or air environment full of smoke. The proposed protection equipment can be used in any part of an aircraft, civilian or military, either the flight deck, or the aircraft passenger compartment/cabin, or the crew rest area, or the cargo area, etc. . . .

The term "deformable membrane" means a flexible layer of material, which is, unless stated otherwise, continuous and does not let air pass through. Flexibility and extensibility of such membrane are substantial.

In various embodiments of the invention, one may possibly have recourse in addition to one and/or other of the following arrangements, taken alone or in combination.

According to one option, there is provided an aperture control device to change the central orifice of the deformable membrane from a large aperture state to a small aperture state in which the deformable membrane circumvents in a substantially airtight manner the neck of the user.

Whereby, it is easy to close the membrane around the neck. The user may actuate the aperture control device to close the membrane around the neck, and advantageously the user may actuate the aperture control device in the reverse direction to open the membrane and release thereby the neck.

According to one option, the aperture control device comprises a stationary member, a movable member and extensible cords, wherein the deformable membrane is formed as a sleeve, wherein a first border and a second border of the deformable membrane being attached to the stationary member wherein, for each cord, a first end is attached to the stationary member and a second end is attached to the movable member.

Whereby, this solution is a simple and reliable arrangement, whatever the shape of the stationary member and the shape of movable member.

According to one option, the aperture control device comprises a stationary ring a movable ring and extensible cords, wherein the deformable membrane is formed as a sleeve, wherein a first border and a second border of the deformable membrane being attached to the stationary ring wherein, for each cord, a first end is attached to the stationary ring and a second end is attached to the movable ring.

Whereby, this solution is a simple and reliable arrangement, since the stationary ring can be rotatably mounted with regard to the movable ring, with optionally sliding guidance between the two rings.

According to one option, the deformable membrane may comprise an elastomeric polymer, with a large elastic extension coefficient, thereby providing a ratio of large aperture versus small aperture as large as 2, preferably 2.5 in terms of area of the central orifice.

It results in an easy installation at large aperture, while tight squeeze at small aperture.

According to one option, the aperture the central orifice of the membrane is, in a large aperture state, large enough to let an adult human head to pass therethrough, in practice a opened cross section of at least 300 $cm^2$, preferably an opened cross section of at least 400 $cm^2$, and more preferably an opened cross section of at least 500 $cm^2$.

This results in an easy installation at large aperture, without damaging or affecting user's hairstyle. The central orifice may exhibit a substantially circular or elliptic shape.

According to one option, there is defined a surfacic ratio L/S defined by the area of the large aperture state divided by the area of the small aperture state, where L/S is at least 4, preferably at least 5, and preferably about 6.

According to one option, there is provided additionally a fabric collar configurable to come into contact with the neck of the user.

This enhances user's comfort. This fabric collar can be replaced, thus improving hygienic conditions. The skin of the neck is not touched directly by the deformable membrane, the skin is only touched by the fabric collar. It should be noted here that the fabric collar is extensible as much as the deformable membrane.

According to one option, the fabric collar can be detachably coupled to a radial middle portion of the deformable membrane. When the movable ring moves, the aperture size reduces, and advantageously the placement of the fabric collar is optimal with regard to the neck of the user.

According to one option, the extensible cords are resilient and provide an elastic return to the large aperture state. Therefore, the rest position is the large aperture state. In addition, since the cords are elastic, thereby use of additional return means can be avoided.

According to one option, the movable ring (62) comprises a control lever (65), actuable manually and/or by a cable. Whereby, handling the movable ring is rather convenient from the user standpoint.

According to one option, the equipment may further comprise a rigid visor (4) movably mounted on the base frame, between a retracted position (P2) and a use position (P1) wherein the rigid visor (4) contacts in an airtight manner the base frame. Whereby, such rigid visor provides good visibility for the user.

According to one option, the hood may comprise an extendible canopy (5) with one or more arches (50) and a flexible wall, coupled in an airtight manner to an upper border of the rigid visor. In this configuration, contact between the top of the head and the hood can be avoided, thus improving user comfort.

According to one option, the aperture control device may be driven by a cable link (96) driven by the rigid visor. This is helpful in practice since, in this configuration, the closing of the rigid visor automatically drives the closing of the deformable membrane.

According to one option, the equipment may further comprise a microphone and one or two loudspeakers. This allows audio communications to be carried out while the protection equipment is worn by the user.

According to one option, the equipment may further comprise a gaseous exchange through one or two gas conduits fluidly coupling the internal closed volume (CV) with an external or remote respirable gas supply. Advantageously the autonomy of the protection equipment can be substantial, since oxygen and/or respirable gas is provided from a reservoir and/or a O2 generator.

BRIEF DESCRIPTION OF THE DRAWINGS

Other features and advantages of the invention appear from the following detailed description of some of its embodiments, given by way of non-limiting examples, and with reference to the accompanying drawings, in which.

DETAILED DESCRIPTION OF THE DISCLOSURE

In the figures, the same references denote identical or similar elements. It should be noted that, for clarity purposes, some element(s) may not be represented at scale.

Figure 1:
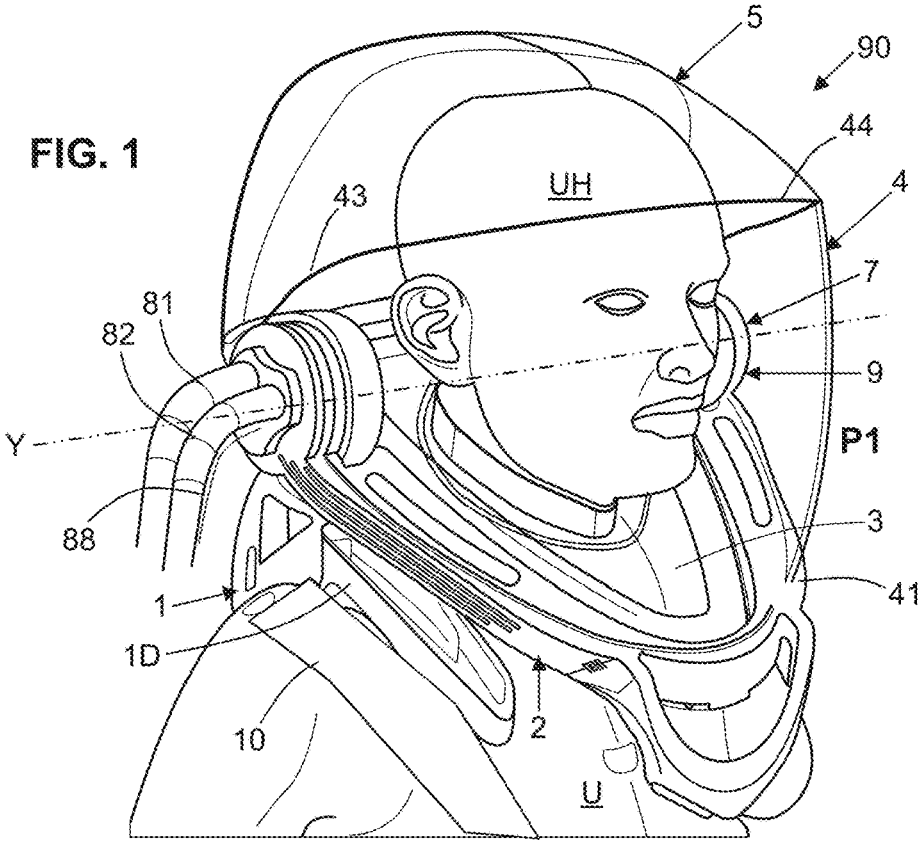
FIG. 1 shows a diagrammatic perspective view of a respiratory equipment according to the present disclosure, with the rigid visor in use position, a closed volume encompassing the pilot's head thereby enabling respiration, and allowing wide visibility.

As shown in FIG. 1, an aircraft pilot denoted U wears a respiratory equipment 90. Instead of a pilot, the user of the respiratory equipment 90 can be a first officer of the aircraft.

The user U of the respiratory equipment can be a male individual or a female individual; anthropometrics can vary from one subject to another, notably size of head, height of the neck, and generally all anthropology metrics.

Also hairstyle can vary from one subject to another; some people have short hair, some people have long hair. The number of female pilots/copilots is increasing and the proposed respiratory equipment shall be compatible with a large range of anthropometric metrics. Advantageously the solution is also compatible with various horsetail/ponytail hairstyles.

Also some male pilots like to wear beard or moustache. Again here many beard styles are considered, as far as hair length or areas covered. The proposed respiratory equipment shall be compatible with most popular beard styles.

In the respiratory equipment, there is provided a shoulder support 1. The shoulder support comprises a left member 1G and right member 1D; there can be provided a linking member 12 to link the left and right support members, said linking member 12 may be arranged at the back area as shown at FIG. 3C. We note here that the linking function can be provided by the base frame that will be discussed later.

Figure 2:
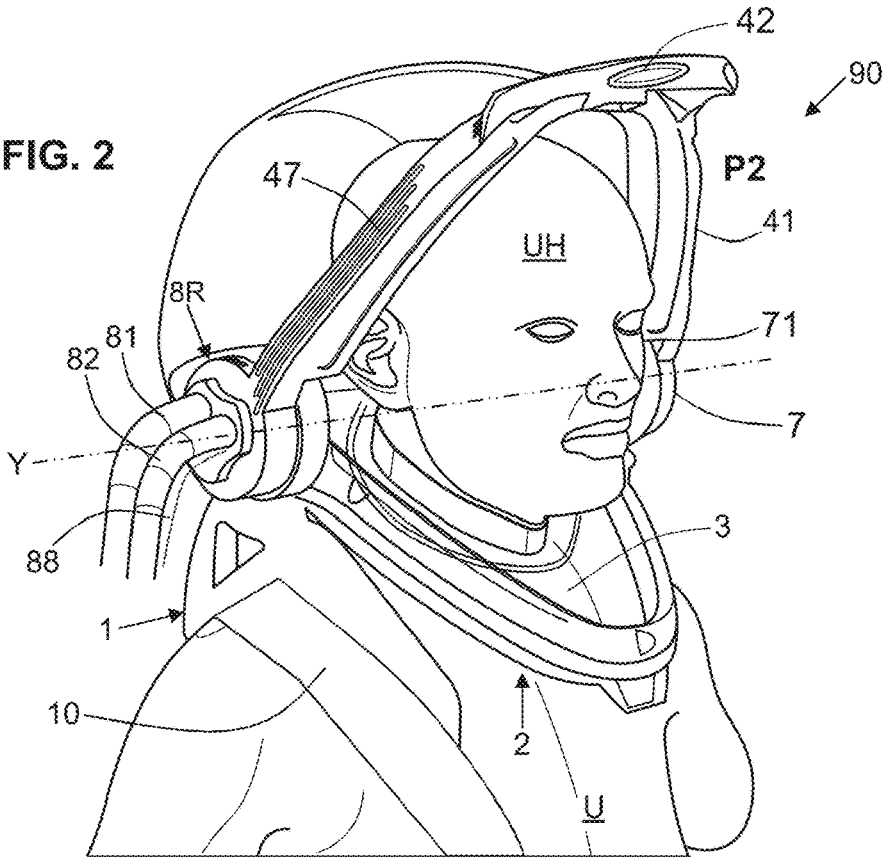
FIG. 2 is analogous to FIG. 1 and shows the respiratory equipment, with the rigid visor in a retracted position, the flight deck ambient air is used for breathing.

As apparent from FIGS. 1 to 2, the shoulder support is compatible with a variety of pilot safety harness 10. In one embodiment, the pilot safety harness 10 can be secured atop a portion of the left and right shoulder support members. In another embodiment, the pilot may have installed beforehand his/her safety harness 10 and install subsequently the respiratory equipment such that left and right shoulder support members locate atop the pilot safety harness 10.

The shoulder support 1 may be adjustable in size:span between the left and right support members can be adapted for example by increments.

The shoulder support may comprise comfort pads in the concave area oriented downward, intended to be in contact with the top of the user's shoulder where weight of the respiratory equipment is mainly transmitted to the user.

The shoulder support 1 may be made of hard synthetic material a reinforced plastic or the like.

Base Frame

There is provided a base frame 2 mounted on the shoulder support 1. In the illustrated example, the base frame is fixedly secured to the shoulder supports, from another perspective the shoulder supports are fixedly secured to the base frame. According to another possible option, there may be provided a height adjustment system to take into account neck human variety; for example the height of base frame with regard to shoulder supports might be adapted, for example by increments, via a latch system of a rotary-controlled rack & pinion.

Figure 4:
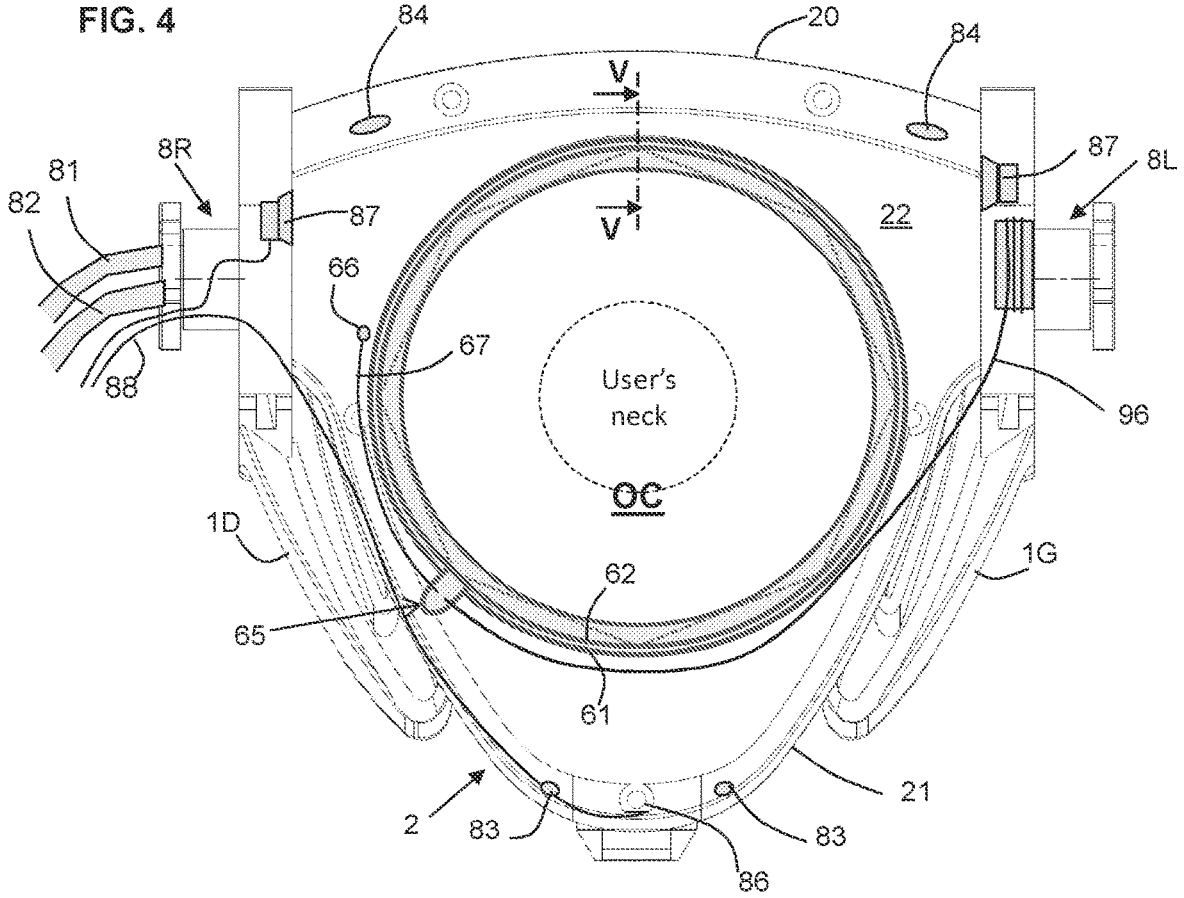
FIG. 4 shows a top view of the base frame, with a deformable membrane in a large aperture configuration, corresponding to the retracted position of the rigid visor.

The base frame comprises an arcuate front portion 21 forming an armature/strength member and a back portion 20, fixed to one another. The back portion can be straight or can have a slightly arcuate shape with the concave side oriented toward the neck axis area, e.g. towards the arcuate front portion 21 (FIG. 4).

The base frame 2 defines a central passage large enough for the user to pass his/her head through. The structure and features encompassed within the base frame will be detailed later.

The base frame 2 may be made of hard synthetic material a reinforced plastic or the like, PET, PP, etc. . . . . There may be provided a metallic armature therein.

Rigid Visor

There is provided a rigid visor 4 movably mounted on the base frame 2, between a retracted position (P2, FIGS. 2 and 3A) and a use position (P1, FIGS. 1 and 3C). In the use position P1, the rigid visor 4 contacts in an airtight manner the base frame 2.

In the illustrated example, the rigid visor 4 is rotatably mounted on the base frame, with a hinge having an axis denoted Y. There is provided an articulation unit 8L at the left side and an articulation unit 8R at the right side, both can have extra function beyond rotative mount as will be seen later.

In the illustrated example, the rigid visor 4 is made of transparent material like polycarbonate or the like. The rigid visor 4 has an overall arcuate shape. The lower border 47 of the rigid visor has a similar shape as the arcuate front portion 21 of the base frame. There may be provided a seal (not shown) to tightly join the lower border of the base frame to the arcuate front portion 21 of the base frame.

The upper border 44 extends front the hinge axis Y upwardly, and there is provided a curve 43 oriented downwards. In this configuration, the pilot/user U has direct view on the environment both forwards and on the sides; good visibility is thus ensured even when the rigid visor 4 is lowered.

There is provided a locking system assembly 7, which will be described later.

Canopy

There is provided an extendible canopy 5 with one or more arches 50 and a flexible wall, coupled in an airtight manner to an upper border of the rigid visor 4.

The extendible canopy 5 comprises a rear wall 51 and a flexible top wall 52 arranged on the arches 50. The top wall of the extendible canopy 5 can be made of a coated fabric or can be made from a flexible polymer material. The rear wall can be made of the same material. According to one option, the material of the rear wall and canopy are integrally formed which is beneficial for air tightness. The canopy material may be translucent or even transparent.

Figure 3A:
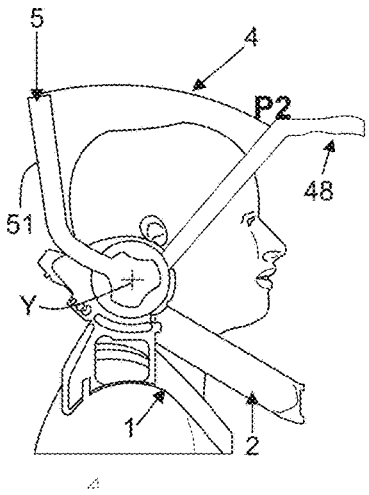
FIGS. 3A, 3B and 3C show the deployment of the extendible canopy and rigid visor from a retracted position to a use position.

The arches 50 of the extendible canopy are arranged so they are encompassed in one another when the extendible canopy is fully retracted (FIG. 3A). More precisely, the arches, when retracted, are piled up like Russian dolls. The arches, when canopy is deployed, also give advantageously structure to the canopy so contact is avoided with the top of the user's head (FIG. 3C). In this configuration, the flexible top wall is tensed. The flexible top is not loose and there is enough room to accommodate many hairstyles without hair touching the canopy. It is therefore very comfortable for the use compared to known hoods.

There is room left for ponytail hairstyle at the rear wall 51.

Advantageously in the retracted position, the upper border of the rigid visor and the arches occupy a small space. Behind the rear wall 51, there is room left with regard to the seat headrest, which provides comfort from the user/pilot standpoint. Therefore there is provided freedom for shoulder movement or shoulder slight rotation without hindrance from the back of the respiratory equipment (shoulder support and canopy rear wall).

There may be provided 2 or 3 arches. Each arch may be made as a flexible rod having a cross-section round or rectangle, for example between 3 $mm^2$ and 5 $mm^2$. Each arch may be made of flexible reinforced plastic material.

The perimeter of the rear wall 51 can be viewed as the rearmost arch.

According to another possibility, all the arches 50 of the extendible canopy may have substantially the same shape as the upper border of the rigid visor.

When the rigid visor 4 is in the closed/use position, there is defined an interior volume which is delimited by the base frame, the extendible canopy and the rigid visor. The respiratory equipment can be viewed as a wide hood or a head contact-free helmet.

The respiratory equipment 90 may comprise two gas conduits 81,82 for providing respirable air to the user from a known-per-se rebreathing.

There may be a single gas conduit instead of two in one configuration not shown.

The respiratory equipment 90 may further comprise a microphone 86 and one or two loudspeakers 87 for enabling audio communication between the user and other people (in the aircraft or remotely located). In the shown example, the microphone 86 is located in front of the mouth of the pilot/user U in use configuration (FIG. 4), there are two loudspeakers 87 are located behind the visor hinge axis.

Further, there is provided an electric cable 88, for linking/coupling the microphone and loudspeakers with the onboard audio equipment and remote communications.

In the illustrated example, the gas conduits 81,82 and the electrical cable 88 enter the interior volume through the right side articulation 8R.

Figure 3B:
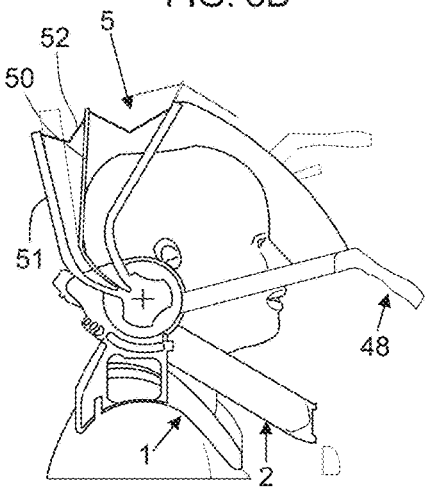
Figure 3C:
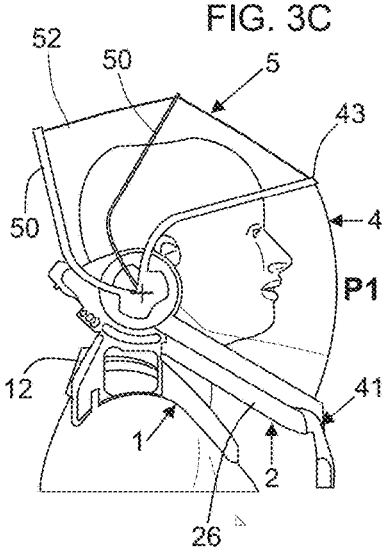
Figure 8:
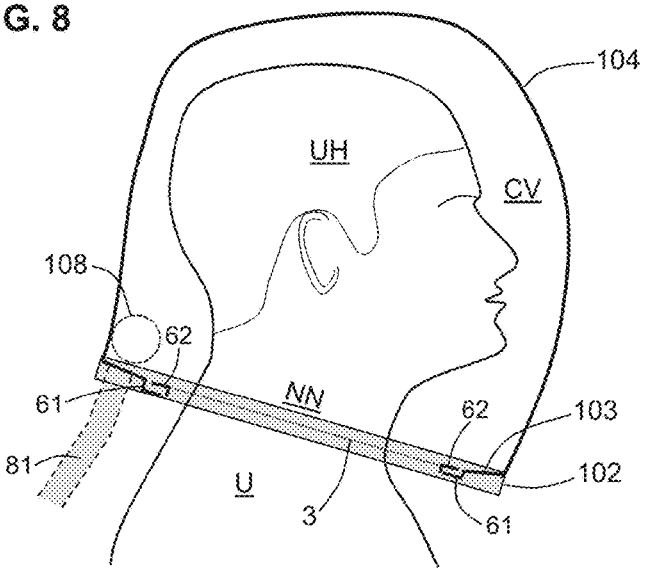
FIG. 8 shows a second embodiment, with a hood-type protection equipment for any individual user.

As apparent from FIGS. 3A to 3C, a movement of the rigid visor drives a movement of the extendible canopy. More precisely, FIG. 3A shows the fully retracted position P2 where the flexible canopy is collapsed on itself with the arches next to one another or the arches encompassed one another (Russian dolls). In this configuration, the pilot has direct view on the environment both forwards and on the sides. When the user U pulls the rigid visor downwards by grasping the handle 48 (with optional prior unlocking as discussed later), the upper border 43 of the visor pulls accordingly the forwardmost arch 50, and the other arches when the movement is carried on. (FIG. 3B shows an intermediate state).

The visor rotates around axis Y. the arches 50 also rotate around axis Y. The rear wall 51 of the extendible canopy remains stationary.

When the rigid visor reaches the lower most position, i.e. in contact with the base frame arcuate portion 21, the flexible wall 52 of the canopy is substantially tensed as illustrated at FIG. 3C. At this point, an interior volume of the respiratory equipment is delimited by the base frame, the extendible canopy and the rigid visor.

Conversely, when the user wants to release the equipment, the user pushes up the rigid visor and the reverse operation takes place with rotation of the visor and collapsing of the extendible canopy.

It is important to note here that the head UH of the user has no contact with the rigid visor, and no element is worn on the face, this is true both in the retracted position P2 and in the use position P1. Thereby the comfort of use is increased.

As apparent from FIGS. 1 to 9, one key feature is the airtightness at the user's neck, and a deformable membrane is provided for that.

Deformable Membrane

There is provided a deformable membrane 3 attached to the base frame 2. There may be provided a bottom junction wall 22 linking in an airtight manner the base member and the deformable membrane 3. The bottom junction wall 22 is arranged outside deformable membrane 3 and is attached in an airtight manner to the base frame 2.

The deformable membrane 3 defines a central orifice OC for the head passage and for the neck interface as discussed further below.

The deformable membrane 3 comprises an elastomeric polymer, with a large elastic extension coefficient, thereby providing a ratio of large aperture versus small aperture as large as 2, preferably 2.5 in terms of area of the central orifice OC.

There is provided a deformable aperture control device 6. The aperture control device 6 allows to change the central orifice OC of the deformable membrane from a large aperture state to a small aperture state in which the deformable membrane circumvents in a substantially airtight manner the neck of the user U.

The aperture control device 6 can also be called 'iris' or 'diaphragm'.

More precisely, according to one illustrative example the aperture control device comprises a stationary ring 61 a movable ring 62 and extensible cords 63.

The deformable membrane is formed as a sleeve, with a first border 31 and a second border 32.

The first border 31 and the second border 32 are both attached to the stationary ring 61.

For each cord 63, a first end is attached to the stationary ring 61 and a second end is attached to the movable ring 62.

Under rotation of the movable ring 62, the cords 63 extend and pull the deformable membrane inwardly along a radial direction (toward the center, i.e. toward the user's neck when present). More precisely, each cord pushes the radial middle portion 30 of the deformable membrane toward the center.

There may be provided fours cords. However the number of cords can be any from 3 to 24. Each cord has a length comprised between 5 cm and 25 cm. The cords are made of extensible elastomeric material. They can be made of natural or synthetic rubber.

Advantageously, the external layer of the cord can be a sliding coating such the extension of the cord does not pull in the tangential direction the radial middle portion 30 of the deformable membrane.

According to another example, the shape of the entities to which the deformable membrane is attached can be different. Any stationary member and movable member, whatever their shape, can be considered instead of rings.

When the central orifice OC of the membrane is in a large aperture state, the central orifice is large enough to let an adult human head to pass therethrough, in practice a opened cross section of at least 300 $cm^2$, preferably an opened cross section of at least 400 $cm^2$, and more preferably an opened cross section of at least 500 $cm^2$.

The smallest size of the central orifice OC of the membrane, when closed, can be as small as 100 $cm^2$, even as small as 70 $cm^2$.

According to one particular option, there is provided additionally a fabric collar 37 configurable to come into contact with the neck of the user; thus enhancing comfort. This fabric collar can be replaced, thus improving hygienic conditions. The fabric collar can be detachably coupled to a radial middle portion 30 of the deformable membrane (cf FIGS. 5 and 12).

The movable ring 62 comprises a control lever 65, actuated by a cable 96. In a variant, a manual actuation is also possible for moving the movable ring 62.

Since the extensible cords 63 are resilient and provide an elastic return to the large aperture state. However, there may be provided additional biasing means to elastically return the movable ring toward a position corresponding to the large aperture state. In the illustrated example, there is provided an elastic string 67 (or tension spring) anchored at one of its end to an attachment 66 rigid with the base frame and the other end is attached to the control lever 65 or to another point rigid with the movable ring 62.

It should be noticed that both the stationary ring 61 and the movable ring 62 can be slightly deformable to become elliptic for allowing the passage of the head of the user when installing/disinstalling the respiratory equipment.

In the illustrated example, the left side articulation unit 8L comprises a locking system 7 and a linking mechanism 9 to drive the movable ring in dependence of the position of the visor.

The air tightness performance of the proposed solution allows to have a pressure difference of 1 bar between the interior closed volume and the exterior environment of the aircraft cabin, without substantial leakage.

Regarding the tightness around the user's neck, there may be provided a third ring 69 movable related to the second double ring 62. This additional control ring allows a fine tuning of tightness by a manual control from the user.

There may be provided a sensor 26 able to detect a closed position of the rigid visor. This enables the avionic system to switch automatically audio communication to the microphone and loudspeakers provided in the respiratory equipment.

Inside the respiratory equipment, there are provided one or more injectors 83 for the entrance of air from the fan and vents 84 for outtake of air from the interior volume to the fan.

There may be provided several sensors (pressure, flow, CO2 . . . ), not shown, to control the system.

Figure 5:
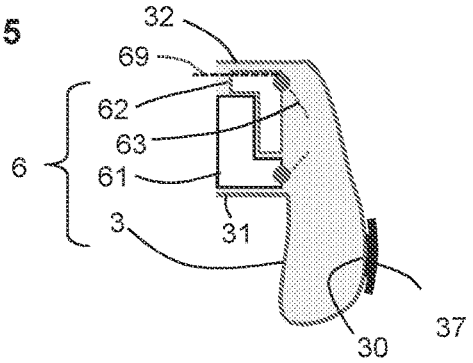
FIG. 5 shows a cross sectional view of the base frame assembly, taken along line V-V in FIG. 4.
Figure 12:
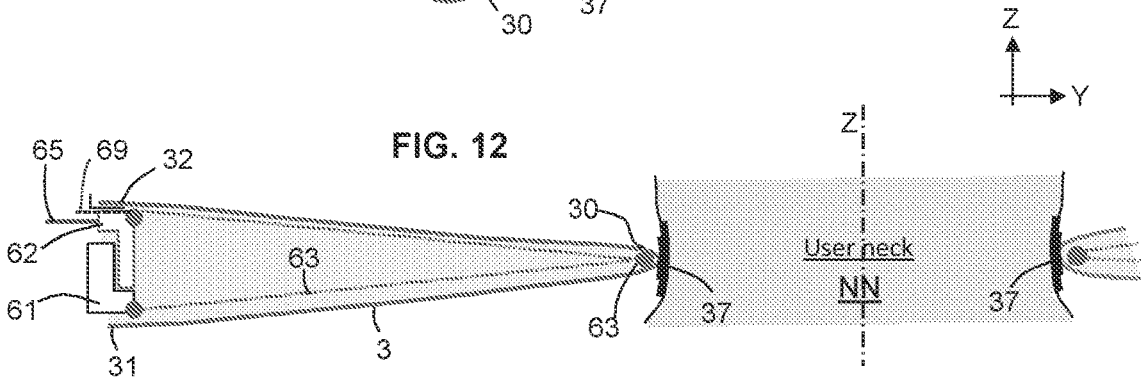
FIG. 12 shows a cross sectional view of the base member and deformable membrane circumventing the neck of the user.
Figure 6:
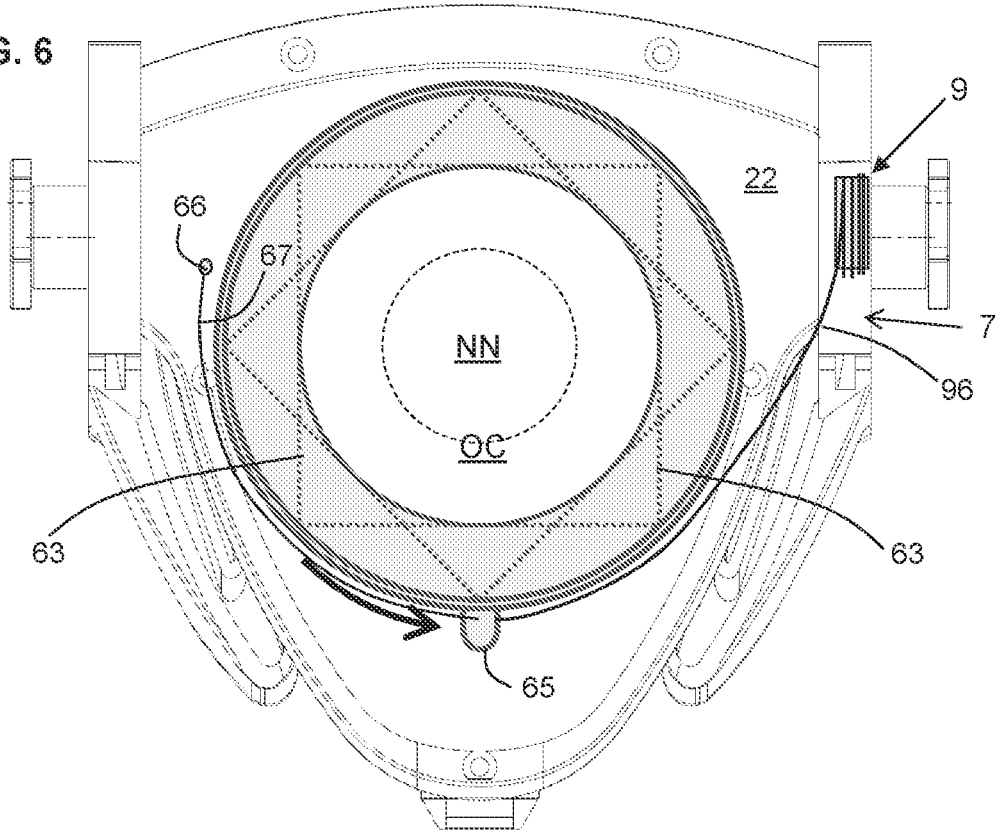
FIG. 6 is analogous to FIG. 4 and shows the deformable membrane during shift to a smaller aperture configuration.
Figure 7:
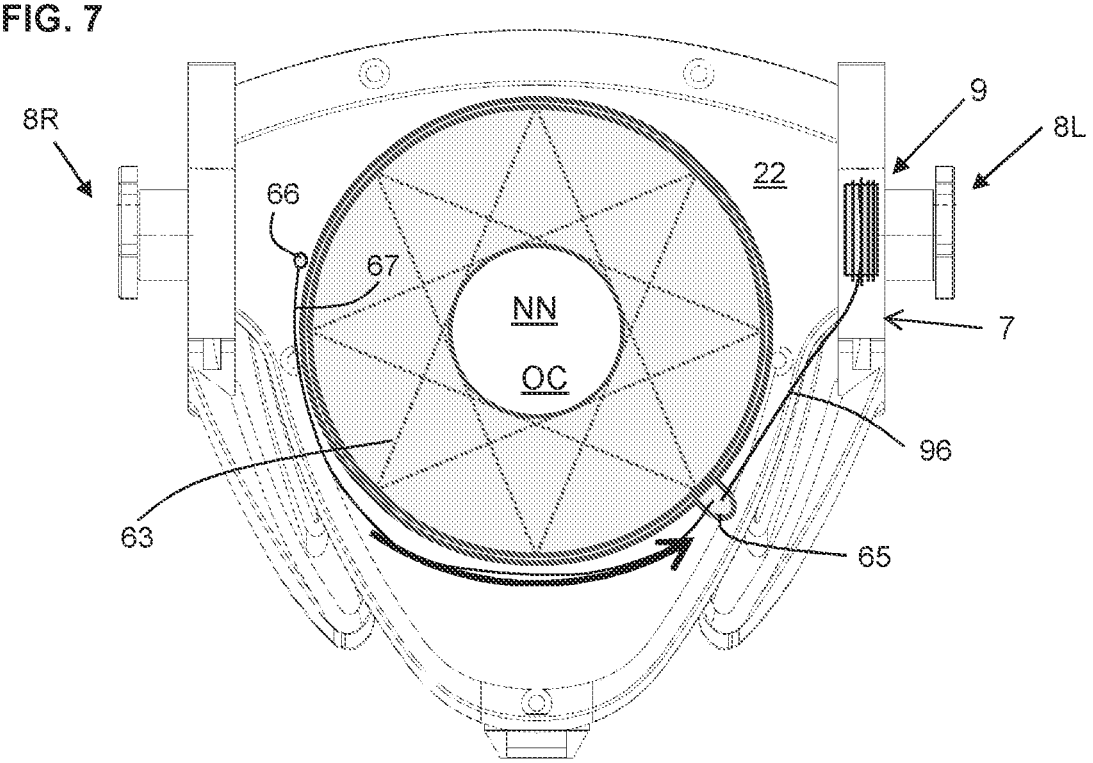
FIG. 7 is analogous to FIG. 4 and shows the deformable membrane in the use position, wherein it circumvents in a substantially airtight manner the neck of the pilot, small aperture configuration.
Figure 9:
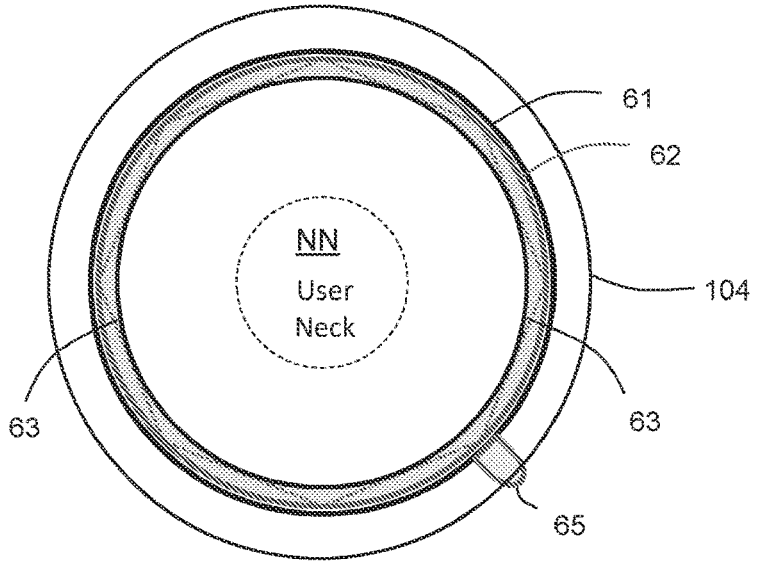
FIG. 9 shows a top view of the base member of the second embodiment, with a deformable membrane in a large aperture configuration.
Figure 10:
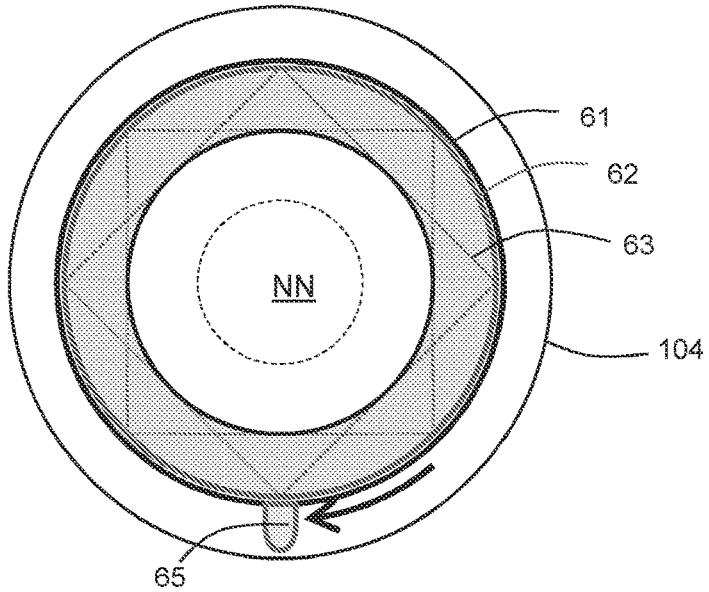
FIG. 10 is analogous to FIG. 9 and shows the deformable membrane during shift to a smaller aperture configuration.
Figure 11:
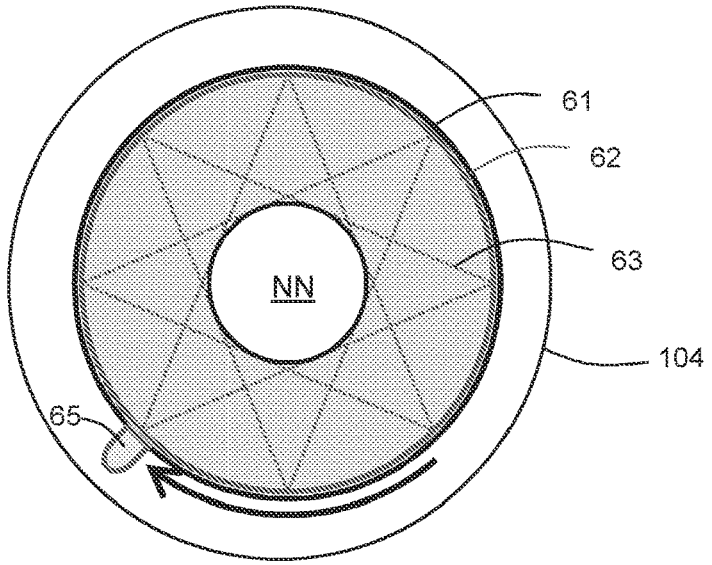
FIG. 11 is analogous to FIG. 9 and shows the deformable membrane in the use position, wherein it circumvents in a substantially airtight manner the neck of the user, small aperture configuration.

A second embodiment is illustrated at FIGS. 8-11. Besides, FIGS. 5 and 12 are common to the first and second embodiments.

In the second embodiment, there is provided a hood 104, which is preferably made of flexible resilient material. Besides, there is provided a transparent portion at least in the front area. The hood 104 is coupled in substantially airtight manner to a base member 102. The material of the hood does not let air go through.

The base member 102 is here a ring like armature that can be handled by the user for the installation of the device on the user head UH.

There is provided a deformable membrane 3 attached to the base member 102. There may be provided a bottom junction wall 103 linking in an airtight manner the base member and the deformable membrane 3.

The deformable membrane 3 defines a central orifice OC for the head passage and for the neck interface as discussed further below.

The deformable membrane 3 comprises an elastomeric polymer, with a large elastic extension coefficient, thereby providing a ratio of large aperture versus small aperture as large as 2, preferably 2.5 in terms of area of the central orifice OC.

There is provided a deformable an aperture control device 6. The aperture control device 6 allows to change the central orifice OC of the deformable membrane from a large aperture state to a small aperture state in which the deformable membrane circumvents in a substantially airtight manner the neck NN of the user U.

The aperture control device 6 can also be called 'iris' or 'diaphragm'.

More precisely, according to one illustrative example the aperture control device comprises a stationary ring 61 a movable ring 62 and extensible cords 63.

The deformable membrane is formed as a sleeve, with a first border 31 and a second border 32.

The first border 31 and the second border 32 are both attached to the stationary ring 61.

For each cord 63, a first end is attached to the stationary ring 61 and a second end is attached to the movable ring 62.

Under rotation of the movable ring 62, the cords 63 extend and pull the deformable membrane inwardly along a radial direction (toward the center, i.e. toward the user's neck when present). More precisely, each cord pushes the radial middle portion 30 of the deformable membrane toward the center.

There may be provided fours cords. However the number of cords can be any from 3 to 24. Each cord has a length comprised between 5 cm and 25 cm. The cords are made of extensible elastomeric material. They can be made of natural or synthetic rubber.

Advantageously, the external layer of the cord can be a sliding coating such the extension of the cord does not pull in the tangential direction the radial middle portion 30 of the deformable membrane.

According to another example, the shape of the entities to which the deformable membrane is attached can be different. Any stationary member and movable member, whatever their shape, can be considered instead of rings.

When the central orifice OC of the membrane is in a large aperture state, the central orifice is large enough to let an adult human head to pass therethrough, in practice a opened cross section of at least 300 $cm^2$, preferably an opened cross section of at least 400 $cm^2$, and more preferably an opened cross section of at least 500 $cm^2$.

The smallest size of the central orifice OC of the membrane, when closed, can be as small as 100 $cm^2$, even as small as 80 $cm^2$.

Likewise, there is defined a surfacic ratio L/S (Large/Small) defined by the area of the large aperture state divided by the area of the small aperture state.

Advantageously, ratio L/S is at least 4, preferably at least 5, and preferably about 6.

According to one particular option, there is provided additionally a fabric collar 37 configurable to come into contact with the neck of the user; thus enhancing comfort. This fabric collar can be replaced, thus improving hygienic conditions. The fabric collar can be detachably coupled to a radial middle portion 30 of the deformable membrane (cf FIG. 12). This fabric collar is made in an extensible material configured to follow the large change in size of the middle portion 30 of the deformable membrane.

The movable ring 62 comprises a control lever 65, actuable manually and/or by a cable.

Since the extensible cords 63 are resilient and provide an elastic return to the large aperture state. However, there may be provided additional biasing means to elastically return the movable ring toward a position corresponding to the large aperture state.

In the hood configuration, there may be provided a local oxygen reservoir 108, or there may be provided a conduit 81 to supply oxygen or fresh air into the closed volume from an external device, adjacent to the hood or remotely arranged.

It shall be understood that the central orifice OC has been shown circular at the figures. But it is in practice a N segment polygon, N being the number of cords. If N=8 it is a octagon, if N=12 it is a dodecagon, etc. . . . The skilled person understands that the higher the number of cords is, the more the central orifice OC converges towards a circular shape.

The invention claimed is:

1. A protection equipment comprising:

a base member with a deformable membrane which comprises a central orifice with an adaptive size, the adaptive size defining a large aperture state in which an adult human head is capable of passing therethrough and a small aperture state configured to selectively circumvent in a substantially airtight manner a neck of a user, a hood coupled in a substantially airtight manner to the base member, whereby a substantially closed volume is provided, the closed volume being delimited by the deformable membrane, the base member, the neck and the hood, an aperture control device to change the central orifice of the deformable membrane from the large aperture state to the small aperture state in which the deformable membrane circumvents in the substantially airtight manner the neck of the user, wherein the aperture control device comprises a stationary ring, a movable ring, and at least three extensible cords, wherein the deformable membrane is formed as a sleeve, wherein a first border and a second border of the deformable membrane are attached to the stationary ring, and wherein, for each cord, a first end is attached to the stationary ring and a second end is attached to the movable ring.

2. The protection equipment according to claim 1, wherein the central orifice of the deformable membrane in the large aperture state comprises an opened cross section of at least 300 $cm^2$.

3. The protection equipment according to claim 2, wherein there is defined a surfacic ratio L/S defined by an area of the large aperture state divided by an area of the small aperture state, where L/S is at least 4.

4. The protection equipment according to claim 1 wherein there is provided additionally a fabric collar configurable to come into contact with the neck of the user.

5. The protection equipment according to claim 4, wherein fabric collar is detachably coupled to a radial middle portion of the deformable membrane.

6. The protection equipment according to claim 1, wherein the at least three extensible cords are resilient and provide an elastic return to the large aperture state.

7. The protection equipment according to claim 1, wherein the movable ring comprises a control lever, actuable manually and/or by a cable.

8. The protection equipment according to claim 1, further comprising a rigid visor and a base frame, the rigid visor movably mounted on the base frame, between a retracted position and a use position wherein the rigid visor contacts in an airtight manner the base frame.

9. The protection equipment according to claim 8, wherein the hood comprises an extendible canopy with one or more arches and a flexible wall, coupled in an airtight manner to an upper border of the rigid visor.

10. The protection equipment according to claim 1, further comprising a rigid visor, wherein the aperture control device is driven by a cable link driven by the rigid visor.

11. The protection equipment according to claim 10, further comprising a microphone and one or two loudspeakers.

12. The protection equipment according to claim 1, further comprising a gaseous exchange through one or two gas conduits fluidly coupling the closed volume with an external or remote respirable gas supply.

* * * * *